US010822948B2

(12) United States Patent
Abel et al.

(10) Patent No.: US 10,822,948 B2
(45) Date of Patent: Nov. 3, 2020

(54) MINE ROOF SUPPORT, PRE-INSTALLATION ASSEMBLY FOR SAME, AND METHOD OF INSTALLATION

(71) Applicant: Burrell Mining Products, Inc., New Kensington, PA (US)

(72) Inventors: Don C. Abel, Lower Burrell, PA (US); Nicholas J. Tennant, Maidsville, WV (US)

(73) Assignee: Burrell Mining Products, Inc., New Kensington, PA (US)

( * ) Notice: Subject to any disclaimer, the term of this patent is extended or adjusted under 35 U.S.C. 154(b) by 0 days.

(21) Appl. No.: 15/940,826

(22) Filed: Mar. 29, 2018

(65) Prior Publication Data

US 2019/0203597 A1 Jul. 4, 2019

Related U.S. Application Data

(60) Provisional application No. 62/611,094, filed on Dec. 28, 2017.

(51) Int. Cl.

| | |
|---|---|
| ***E21D 15/30*** | (2006.01) |
| ***E21D 15/48*** | (2006.01) |
| ***E21D 23/06*** | (2006.01) |
| ***E21D 23/04*** | (2006.01) |

(52) U.S. Cl.

CPC ..... *E21D 15/303* (2013.01); *E21D 15/483* (2013.01); *E21D 23/0481* (2013.01); *E21D 23/06* (2013.01); *E21B 2200/05* (2020.05)

(58) Field of Classification Search

CPC ..... E21D 15/14; E21D 15/44
USPC ..... 405/288
See application file for complete search history.

(56) References Cited

U.S. PATENT DOCUMENTS

| | | | | |
|---|---|---|---|---|
| 4,570,397 | A * | 2/1986 | Creske | E04D 11/007 52/126.6 |
| 5,308,196 | A | 5/1994 | Frederick | |
| 8,246,276 | B2 * | 8/2012 | Bower | E21D 15/483 299/11 |
| 8,851,805 | B2 | 10/2014 | Shook et al. | |
| 2012/0243945 | A1 * | 9/2012 | Swingler | E02D 7/10 405/225 |
| 2012/0269585 | A1 | 10/2012 | Faulkner | |
| 2014/0348596 | A1 | 11/2014 | Hussey et al. | |

FOREIGN PATENT DOCUMENTS

| | | | |
|---|---|---|---|
| WO | 2017/147262 | A1 | 8/2017 |

OTHER PUBLICATIONS

Written Opinion of the International Searching Authority for PCT Application No. PCT/US2018/0055929, dated Jan. 7, 2019, 5 pages.
International Search Report for PCT Application No. PCT/US2018/0055929, dated Jan. 7, 2019, 4 pages.

* cited by examiner

*Primary Examiner* — Sean D Andrish
(74) *Attorney, Agent, or Firm* — TraskBritt

(57) ABSTRACT

A mine roof support comprises two or more frusto-conical, tubular sections, the sections each flared outwardly from an upper end to a lower end thereof, a skirt portion of a section being received and secured within a neck portion of a section below in a frictional fit to define an interior volume of the mine roof support. A solid, compressible, load-bearing material is located within the volume. Methods of installing a mine roof support and a pre-installation assembly for a mine roof support are also disclosed.

20 Claims, 7 Drawing Sheets

MINE ROOF SUPPORT, PRE-INSTALLATION ASSEMBLY FOR SAME, AND METHOD OF INSTALLATION

CROSS-REFERENCE TO RELATED APPLICATION

This application claims the benefit under 35 U.S.C. § 119(e) of U.S. Provisional Patent Application Ser. No. 62/611,094 filed Dec. 28, 2017, the disclosure of which is hereby incorporated herein in its entirety by this reference.

TECHNICAL FIELD

Embodiments of the present disclosure relate to mine roof supports. More particularly, embodiments of the present disclosure relate to a telescoping mine roof support, a pre-installation assembly for the support, and a method of installation.

BACKGROUND

Mine roof supports of various types are well known. One very successful mine roof support is disclosed in U.S. Pat. No. 5,308,196 and marketed as THE CAN® support, by Burrell Mining Products, Inc. of New Kensington, Pa. This support comprises a one-piece outer metal housing filled with a compressible load-bearing material, such as grout.

Other mine roof supports include telescoping assemblies of several cylindrical tubular sections which are extended between a mine floor and roof. Some such supports may be filled with a material such as grout, which hardens into a solid, load-bearing, compressible material. Examples of such a support are disclosed and claimed in U.S. Pat. No. 8,851,805, assigned to the assignee of the present application, and the disclosure of which is hereby incorporated herein in its entirety by this reference.

BRIEF SUMMARY

In some embodiments, a mine roof support comprises two or more frusto-conical, tubular sections, the sections each flared outwardly from an upper end to a lower end thereof, a skirt portion of a section being received and secured within a neck portion of a section below in a frictional fit to define a volume within the secured sections. A solid, compressible, load-bearing material is located within the volume.

In other embodiments, a method of installing a mine roof support comprises placing a mine roof support comprising at least two sections in an installation location, each of the at least two sections of frusto-conical configuration and flared outwardly from an upper end to a lower end thereof, at least one of the at least two sections being nested within at least one other of the two or more sections. An innermost section of the at least two sections is pulled upwardly within a next adjacent section until an outer surface of the lower end contacts and frictionally engages with an inner surface of the next adjacent section to secure the innermost section to the next adjacent section.

In further embodiments, a pre-installation assembly for a mine roof support comprises three tubular, frusto-conical sections in a nested arrangement, a skirt portion of each section defining a larger diameter than a neck portion of a next outer adjacent section, wherein each section is flared outwardly from an upper end to a lower end thereof at substantially the same angle $\alpha$ of departure to a longitudinal axis of the section of between about 0.01° and about 3°.

DETAILED DESCRIPTION

Figure 1A:
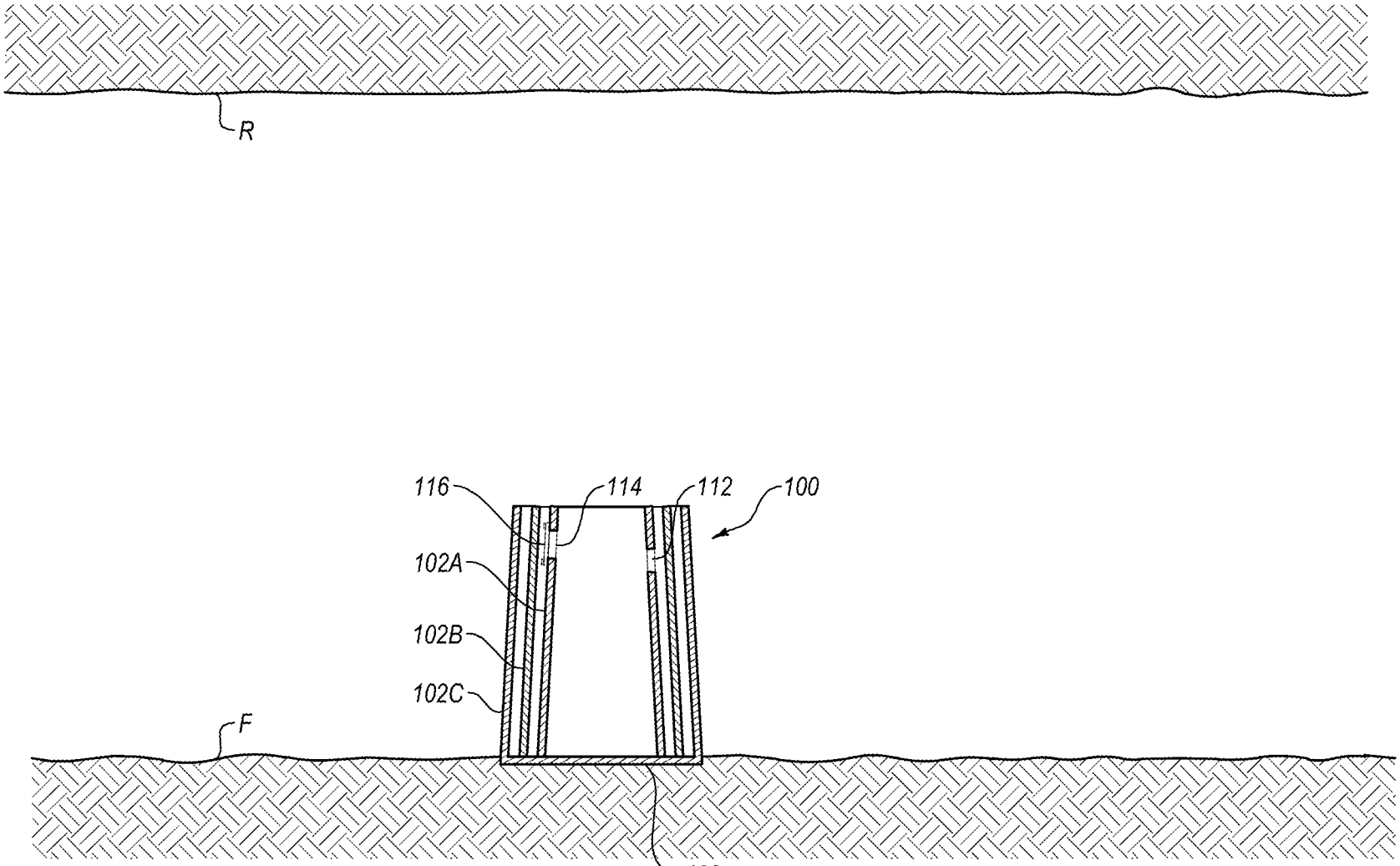
FIG. 1A is a schematic side sectional elevation of an embodiment of a mine roof support of the disclosure as placed in a room of an underground mine for installation.

The illustrations presented herein are not actual views of any particular mine roof support or method of installation, but are merely idealized representations that are employed to describe embodiments of the present disclosure.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles between surfaces that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the terms "longitudinal," "vertical," "lateral," and "horizontal" are in reference to a major plane of a substrate (e.g., base material, base structure, base construction, etc.) in or on which one or more structures and/or features are formed and are not necessarily defined by earth's gravitational field. A "lateral" or "horizontal" direction is a direction that is substantially parallel to the major plane of the substrate, while a "longitudinal" or "vertical" direction is a direction that is substantially perpendicular to the major plane of the substrate. The major plane of the substrate is defined by a surface of the substrate having a relatively large area compared to other surfaces of the substrate.

As used herein, spatially relative terms, such as "beneath," "below," "lower," "bottom," "above," "over," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "over" or "above" or "on" or "on top of" other elements or features would then be oriented "below" or "beneath" or "under" or "on bottom of" the other elements or features. Thus, the term "over" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the terms "configured" and "configuration" refer to a size, shape, material composition, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

Referring to FIGS. 1A through 1D and FIG. 2, an embodiment of a mine roof support of the disclosure is described below.

Referring to FIG. 1A of the drawings, mine roof support 100 comprises two or more sections 102 (collectively referring to sections 102A, 102B, and 102C) of tubular, frusto-conical metal sheathing. Each section may, for example, be formed of steel, rolled into a desired frusto-conical configuration with no out of round portions, as shown in FIG. 2, and welded along a seam that extends from an upper end to a lower end thereof. A non-limiting example of a suitable metal material for the sheathing is AISI 1008 HRS carbon steel, of between 0.062 in. (16 ga.) and 0.109 in. (12 ga.) wall thickness. As shown, mine roof support 100 comprises three sections, 102A, 102B and 102C, referenced from innermost section 102A to outermost section 102C as nested together in a collapsed assembly on floor F of a room of an underground mine, such as, but not limited to, a coal mine. The configuration of each section 102 is such that an upper end 104 thereof is of slightly smaller diameter than a lower end 106 thereof, and the lower end 106 thereof is of slightly greater diameter than the upper end of a next-outermost section 102. With reference to the longitudinal axis L of the support (see FIG. 2), an acute angle $\alpha$ of departure of a wall 108 of each section is extremely small, on the order of, by way of non-limiting example, about 0.01° to about 3°. Angle $\alpha$ is exaggerated greatly in FIGS. 1A through 1D and in FIGS. 2 and 3 for clarity, as is the thickness of the metal sheathing of sections 102A-102C. Each of sections 102A, 102B and 102C may be of substantially the same height and exhibit substantially the same angle $\alpha$ of departure. Outermost section 102C, of largest diameter, may have a floor 103 of the same metal material as the metal sheathing, welded at its perimeter to the lower end of outermost section 102C. FIG. 2 does not show floor 103, depicting only a frusto-conical portion of sections 102A, 102B and 102C.

Figure 1B:
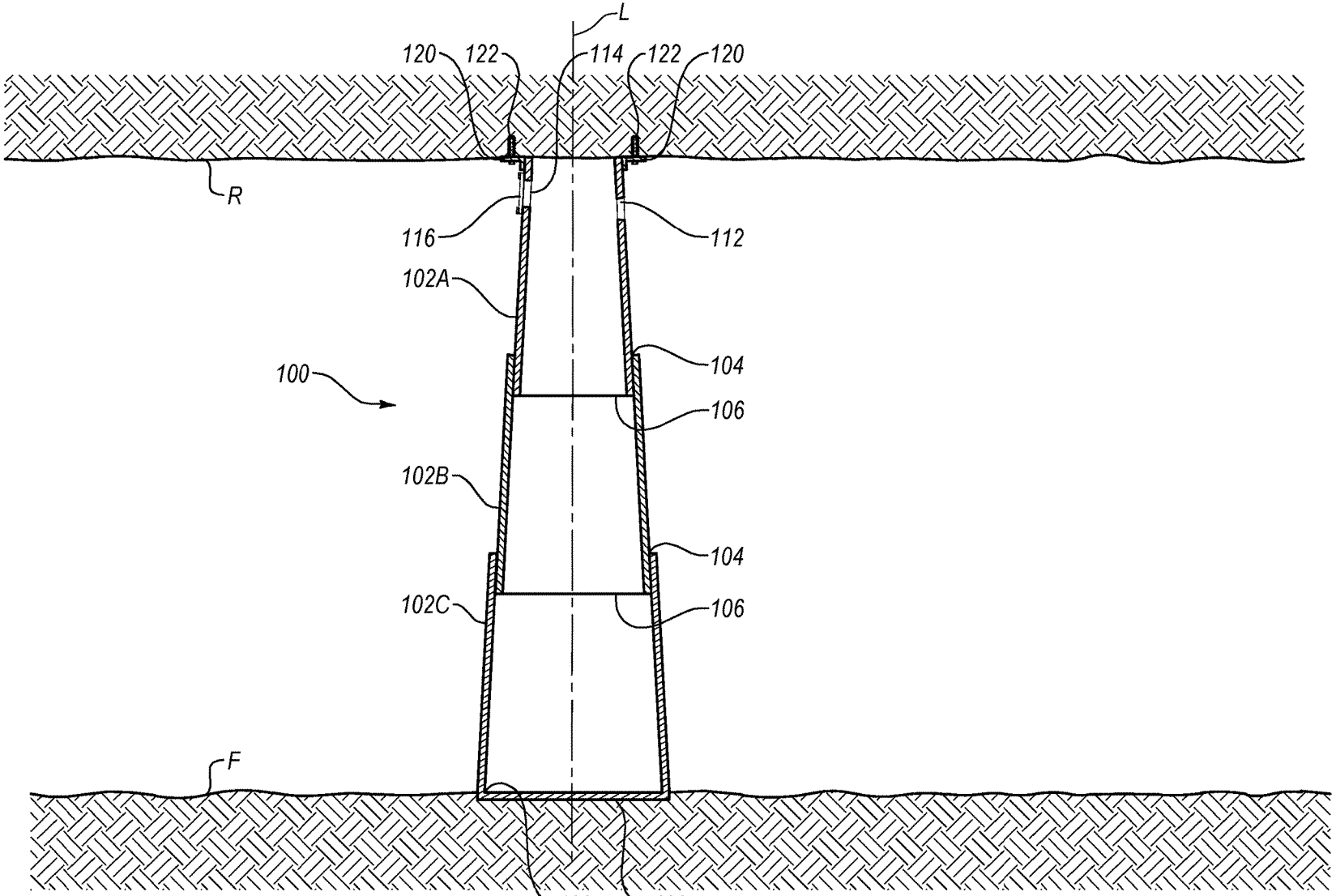
FIG. 1B is a schematic side sectional elevation of the mine roof support of FIG. 1A, extended between the floor and roof of the underground mine room and secured to the roof.
Figure 2:
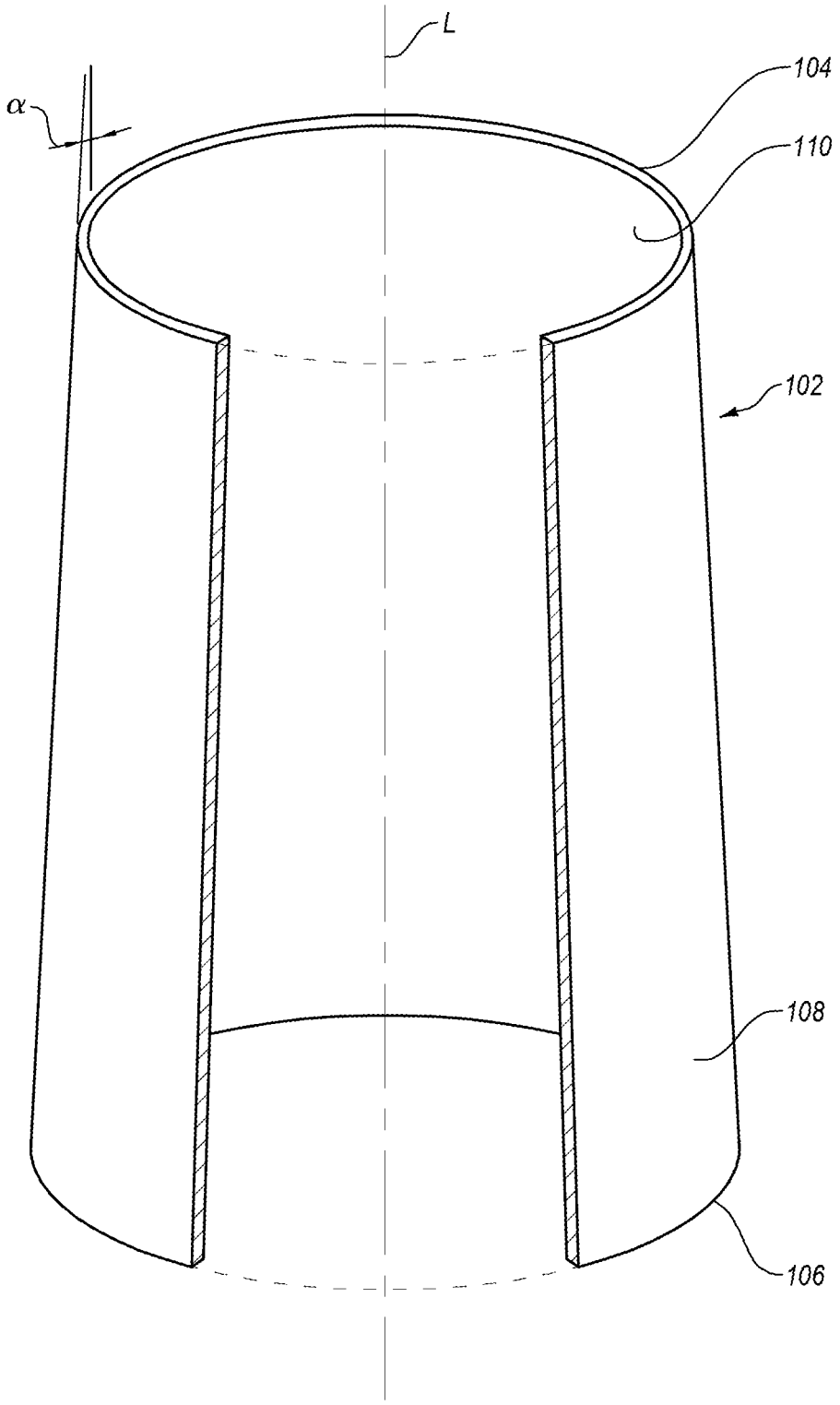
FIG. 2 is an enlarged, partial sectional elevation of a frusto-conical portion of a section of the embodiment of a mine roof support of FIGS. 1A through 1D.

Referring to FIG. 1B of the drawings, mine roof support 100 has been extended, which may also be characterized as telescoped, upwardly from mine floor F to mine roof R along a single longitudinal axis L. As shown, uppermost section 102A is secured to mine roof R with structure comprising, for example, straps 120 (not shown in FIG. 1A for clarity) secured to upper end of uppermost section 102A as by welds or rivets (not shown), and to mine roof R with bolts 122. Such a securing arrangement is disclosed and claimed in the aforementioned U.S. Pat. No. 8,851,805. As shown in FIG. 1B, the lower end 106 of section 102A is captured within the upper end 104 of section 102B. Stated another way, and referring to FIG. 2, the skirt portion of wall 108 above the lower end 106 of section 102A is captured within a neck portion 110 below the upper end 104 of section 102B. Similarly, the skirt portion of wall 108 above the lower end 106 of section 102B is captured within the neck portion 110 below the upper end 104 of section 102C. The slight angle $\alpha$ of the frusto-conical sections 102A-102C enables a continuous circumferential friction fit between the skirt portion of wall 108 of a section 102 and the neck portion 110 of a next-lower section 102, providing a substantially fluid-tight seal between the two sections 102. Section 102A may include an inlet port 112 and an optional vent aperture 114, the latter closed by resilient flapper valve 116, the purpose of which is explained below.

Figure 1C:
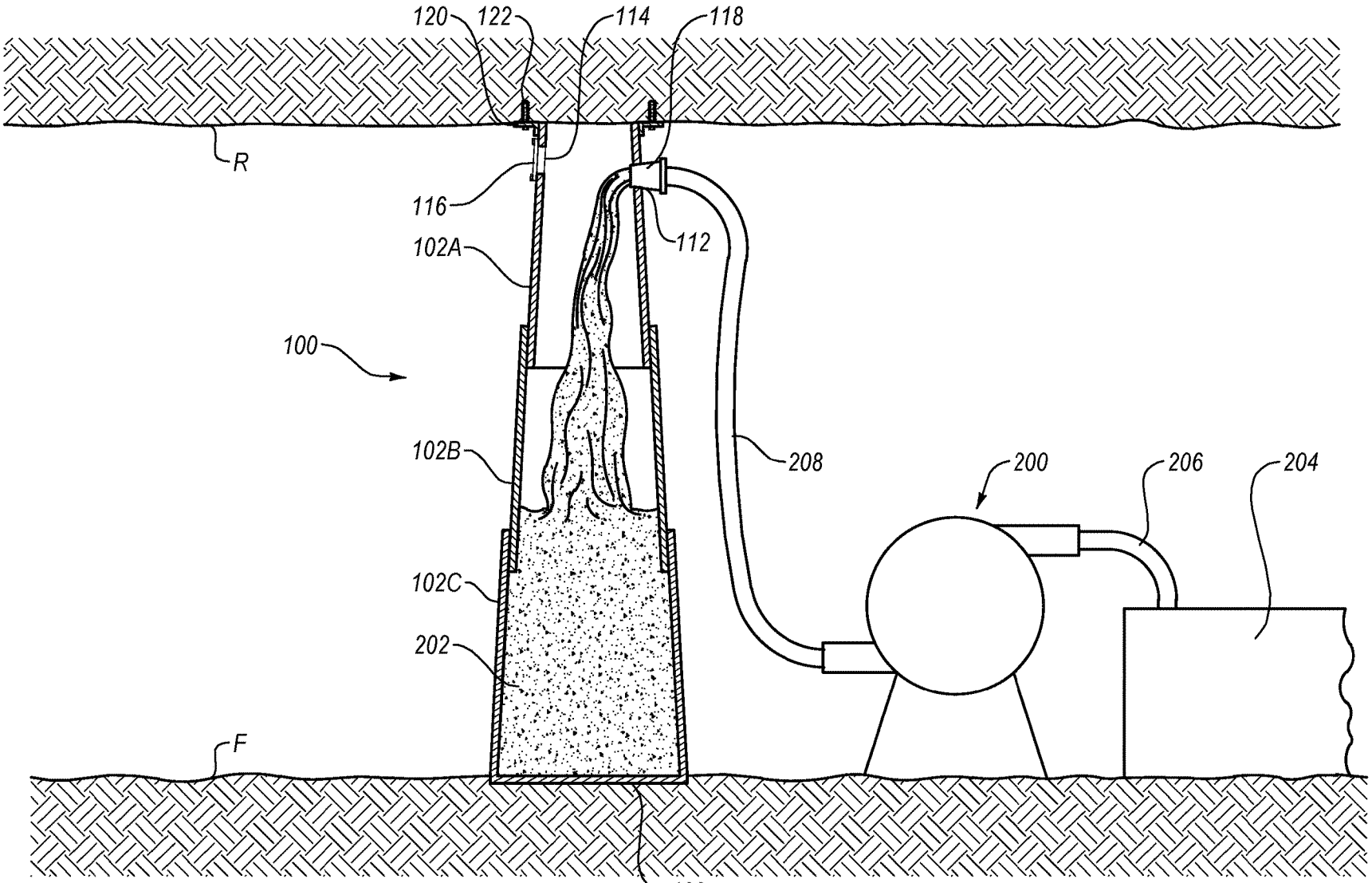
FIG. 1C is a schematic side elevation of the mine roof support of FIGS. 1A and 1B, being filled with grout.

Referring to FIG. 1C, mine roof support 100, as extended and secured to mine roof R as depicted in FIG. 1B, is now filled with a flowable medium 202, for example a slurry in the form of a lightweight cementitious grout or a self-hardening foam material, which may or may not be aerated or "foamed," until the entire mine roof support is filled. As shown, pump 200 draws the flowable medium 202 from flowable medium source 204 through a conduit, such as a hose 206, and pressurizes flowable medium 202 which is directed into an inlet port 112 in section 102A of mine roof support 100 via another conduit 208. As shown, an optional vent aperture 114 may be located proximate the top of section 102A to enhance venting of air from above flowable medium 202 within mine roof support 100. Floor 103 of outermost section 102C prevents the flowable medium from exiting the bottom of mine roof support 100 as the flowable medium fills the continuous interior volume of the mine roof support, as shown. When mine roof support 100 is completely filled with flowable medium 202, vent aperture 114 may be closed with a resilient flapper valve 116. Flapper valve 116 may, in some embodiments, comprise a rubber or other elastomeric sheet secured across vent aperture 114 so that air may be vented from the interior of mine roof support 100, but when flowable medium 202 exits vent aperture 114, pumping can be stopped and flapper valve 116 automatically closes vent aperture 114. If a vent aperture is not employed, flowable medium 202 exiting between the top of mine roof support 100 at the upper end of section 102A and the mine roof R may be used as an indication that the mine roof support 100 is filled. Although inlet port 112 has been depicted in section 102A, inlet port 112 may be located in section 102B or 102C, if desired. It should be noted that filling mine roof support 100 with a flowable medium 202, since flowable medium 202 will fill from the bottom of mine roof support upwardly, will force the skirt portion of wall 108 of each section 102 outwardly and more firmly against the neck portion 110 of a next-lower section 102. Once mine roof support 100 has been completely filled with flowable medium 202, inlet port 112 may be closed with a plug, or a check valve pre-installed within inlet port 112 (both such structures being indicated by generic reference numeral 118) may be used to prevent back flow of flowable medium 202 once pump 200 is stopped.

Figure 1D:
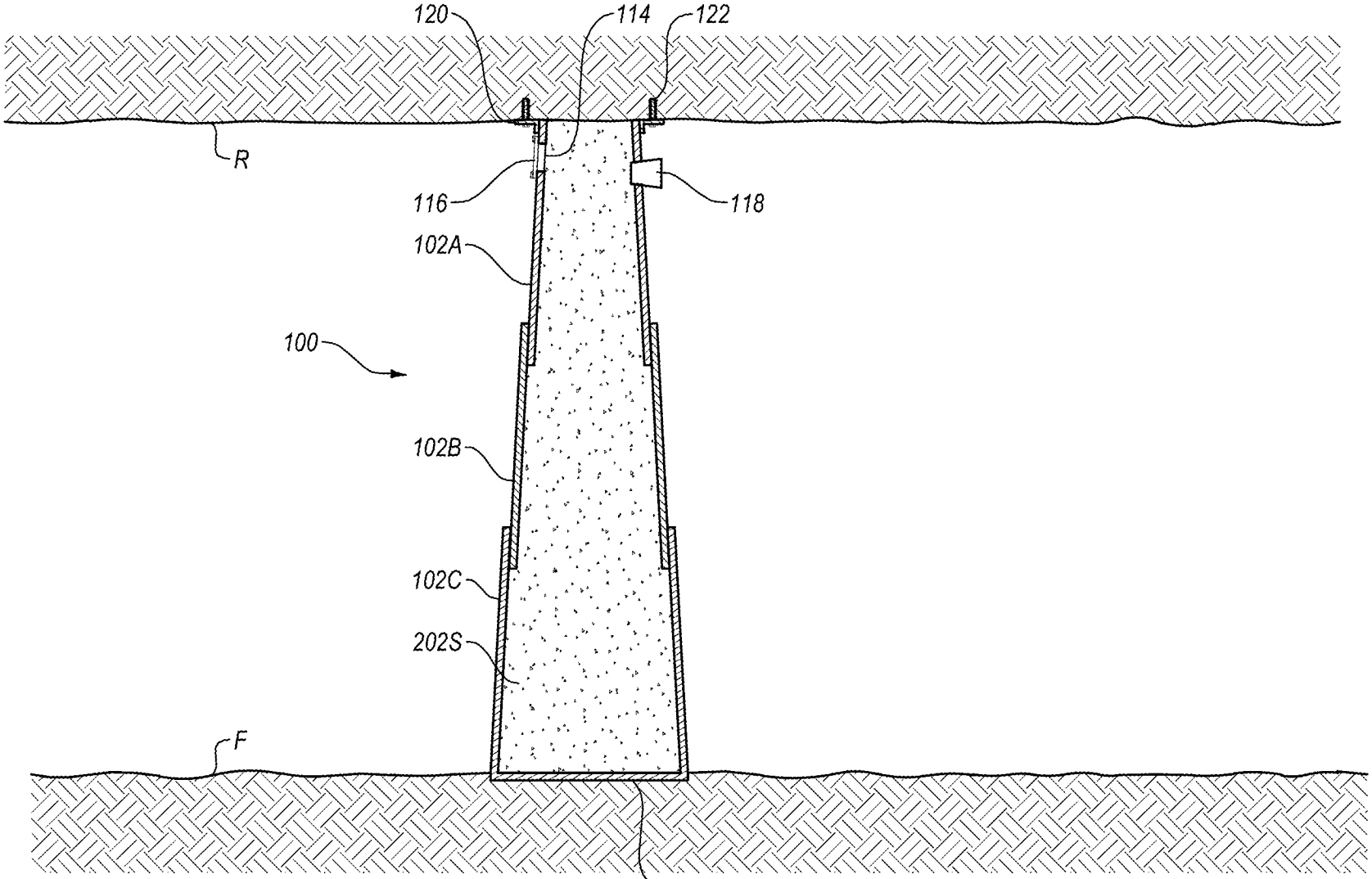
FIG. 1D is a schematic side elevation of the mine roof support of FIGS. 1A through 1C, filled with grout, which is now set.
Figure 3:
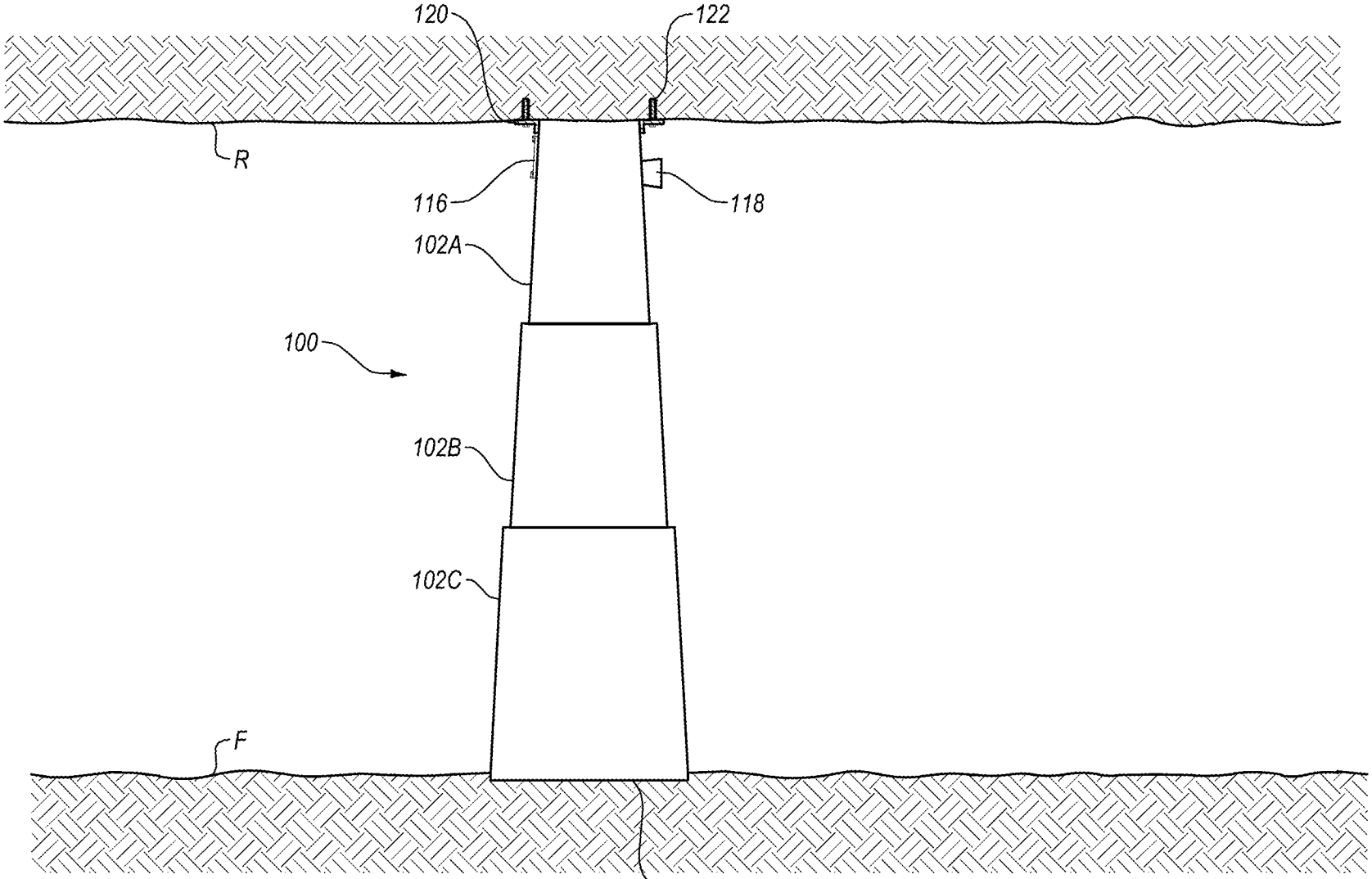
FIG. 3 is a schematic side elevation of an embodiment of a mine roof support of the disclosure as installed between a floor and roof of an underground mine.

As shown in FIG. 1D, mine roof support 100 is now filled with flowable medium 202, which may cure or otherwise harden over time to provide a solid, compressible, continuous, load-bearing filler material 202*s* within the continuous interior volume of the mine roof support 100. FIG. 3 depicts the exterior of mine roof support 100 in place between a floor F and roof R of a room in a mine after hardening of flowable medium 202 to a solid state 202*s*. As noted above, if the flowable medium 202 is grout, the grout may or may not be aerated. If aerated, the solid, compressible, load-bearing medium may be characterized as an aerated cementitious material.

Mine roof supports according to embodiments of the disclosure may be designed to carry an average load of at least between about 100,000 lbs. and about 350,000 lbs, depending upon the size of the support. An aerated cementitious material such as, for example, foamed concrete having a density between about 40 to 60 ft.$^3$ may be employed as a filler material. The mine roof support will yield longitudinally when subjected to a longitudinal load during subsidence of a mine roof. Yielding is effected by compression of the foamed grout filler material, collapsing air pockets in the foam, in combination with one or more of the frusto-conical sections 102 of mine roof support 100 folding upon itself in multiple folds as the filler material compresses.

Figure 4:
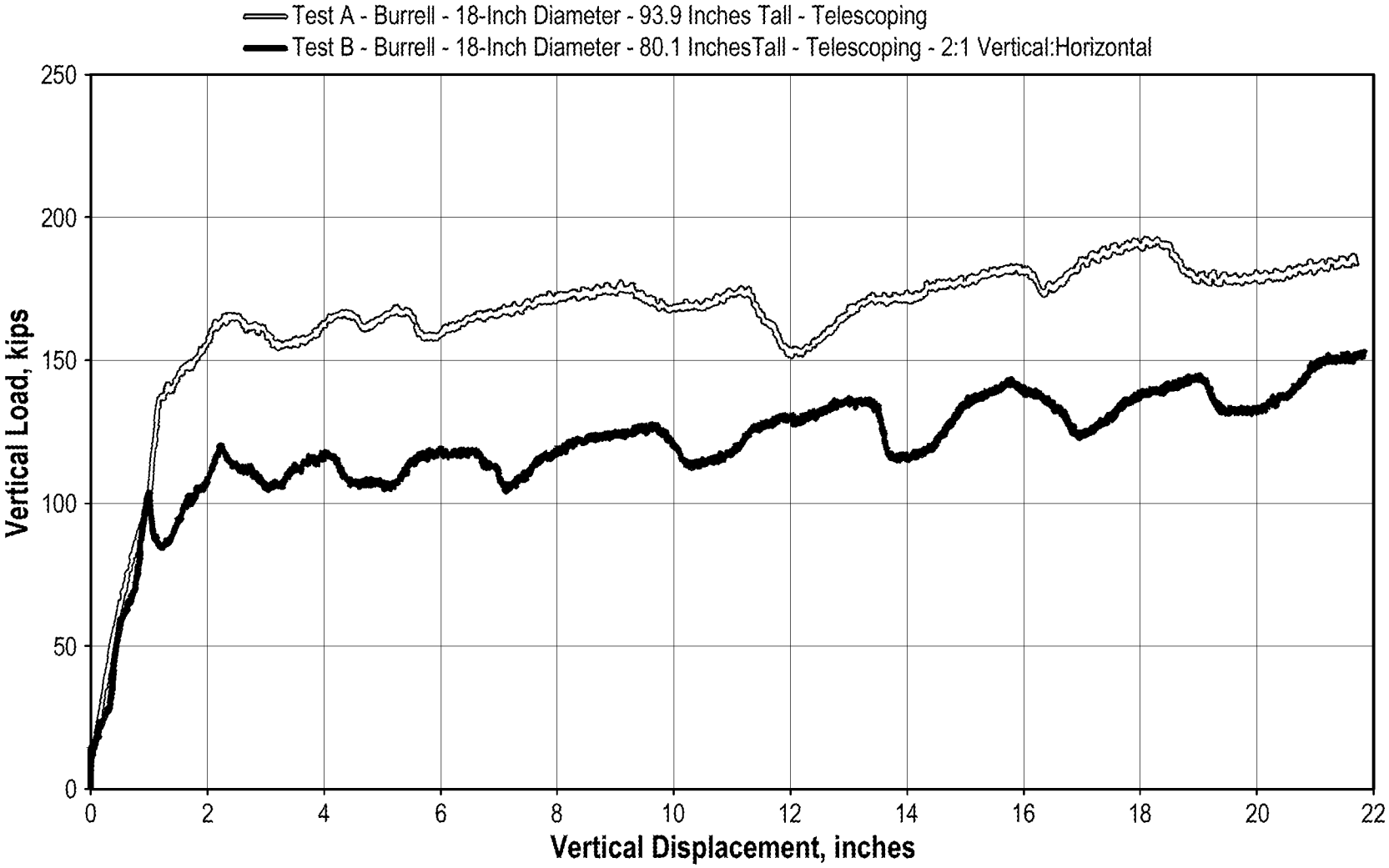
FIG. 4 is a graph of results of tests of embodiments of the disclosure at the National Institute for Occupational Safety and Health (NIOSH) Safety Structures Testing Laboratory.

FIG. 4 is a graphical representation of actual test results for two tests of mine roof supports according to embodiments of the disclosure as conducted at the NIOSH Research Laboratory, Pittsburgh, Pa. Each mine roof support was comprised of three (3) sections filled with an aerated grout, the grout then being allowed to cure. In test A the mine roof support metal sheathing was formed of 0.078 in. (14 ga.) AISI 1008 HRS carbon steel and filled with an aerated grout of about 45 lb./ft.$^3$ density. The support had a nominal diameter of eighteen inches, and an initial height of 93.9 inches. After less than two inches of compression in a test apparatus, the mine roof support was able to bear a load of about 150 kips, which load bearing capacity was maintained or even increased to over 175 kips over a total yield range of almost 22 inches, at which point the test was concluded. In test B the mine roof support metal sheathing was formed of 0.078 in. (14 ga.) AISI 1008 HRS carbon steel and filled with an aerated grout of about 45 lb./ft.$^3$ density. The support had a nominal diameter of eighteen inches, and an initial height of 80.1 inches. After substantially less than two inches of compression in the test apparatus, the mine roof support was able to bear a load of about 100 kips, which load bearing capacity was maintained and then increased to about 150 kips toward the end of a total yield range of about 22 inches, at which point the test was concluded. Each mine roof support tested was able to support a significant load after less than two inches of compression. Significantly, for Test B the test apparatus upper plate moved one inch horizontally for each two inches of downward vertical movement during compression, simulating relative movement of an actual mine room roof with respect to a mine floor while the test mine roof support maintained and even increased load bearing capacity.

Each mine roof support tested yielded in a predictable manner while supporting a load, and yielded only a short distance before substantial load bearing capacity was reached. As shown in FIG. 4 by the wave-like configuration of the graphed results, in each test the load bearing capacity varied as the mine roof support was compressed responsive to folding or wrinkling of the metal sheathing on itself. As the metal sheathing folds, the load bearing capacity of the mine roof support slightly decreases, whereas when a fold has been formed, the load bearing capacity increases. However, the decreases and increases in load bearing capacity are maintained within a predictable, relatively narrow range.

The mine roof support of the disclosure, in various embodiments, is also believed by the inventors herein to accommodate some relative lateral shifting between a roof and a floor of a mine room in which the mine roof support is placed without significant loss in load bearing capacity.

The mine roof support of embodiments of the disclosure provides a short, lightweight, compact, easy-to-transport pre-installation assembly which can be more easily placed in a room of an underground mine than many existing supports which, as transported and placed in a mine, must approximate the height of the roof above the mine floor. In addition, the telescoping nature of the assembly, when unfilled with grout or another load-bearing, compressible medium, enables accommodation of some variation of distance between the mine floor and roof without the use of wooden cribbing or other spacing materials. Further, the frusto-conical configuration and mutual frictional engagement of the mine roof support sections enables a substantially fluid-tight seal between the sections of the support without the use of sealing elements of any type.

While particular embodiments of the disclosure have been shown and described, numerous variations and alternative embodiments are contemplated by the inventors herein and will be recognized by those of ordinary skill in the art. Accordingly, the scope of the invention is only limited by the appended claims and their legal equivalents.

What is claimed is:

1. A mine roof support, comprising:

two or more frusto-conical, tubular sections mutually extended in a telescoping manner along a single longitudinal axis, the two or more frusto-conical, tubular sections each flared outwardly from an upper end to a lower end thereof, a skirt portion of a wall above a lower end of a section being received and secured within a neck portion of a wall below an upper end of a section below in a continuous circumferential frictional fit between an outer surface of the wall above the lower end of the skirt portion and an inner surface of the neck portion of the wall of the section below, providing a substantially fluid-tight seal between the section and the section below, the two or more frusto-conical, tubular sections defining a continuous interior volume of the mine roof support;

wherein only a lowermost frusto-conical, tubular section of the two or more frusto-conical, tubular sections comprises a floor proximate a lower end thereof, each of one or more other frusto-conical, tubular sections of the two or more frusto-conical, tubular sections having an open lower end; and a solid, compressible, continuous, load-bearing aerated material located within the continuous interior volume;

wherein the two or more frusto-conical, tubular sections each comprise metal sheathing of a wall thickness selected to fold or wrinkle on itself responsive to compression of the solid, compressible, continuous, load-bearing aerated material located within the continuous interior volume.

2. The mine roof support of claim 1, wherein the two or more frusto-conical, tubular sections comprise three frusto-conical, tubular sections.

3. The mine roof support of claim 2, wherein each of the three frusto-conical, tubular sections is of substantially a same height.

4. The mine roof support of claim 1, wherein the solid, compressible load-bearing aerated material comprises a cementitious material.

5. The mine roof support of claim 1, wherein each section is flared outwardly at substantially a same angle $\alpha$ of departure to a longitudinal axis of the section.

6. The mine roof support of claim 5, wherein the same angle $\alpha$ of departure is between about 0.01° and about 3°.

7. The mine roof support of claim 1, further comprising two or more straps secured to an upper end of an uppermost section and configured to be secured to a mine roof.

8. The mine roof support of claim 1, wherein one of the two or more frusto-conical, tubular sections includes an inlet port for receiving a precursor flowable medium to the solid, compressible, load-bearing aerated material in a flowable state into an interior of the mine roof support.

9. The mine roof support of claim 8, wherein an uppermost one of the two or more frusto-conical, tubular sections includes a vent aperture proximate the upper end thereof.

10. The mine roof support of claim 9, wherein the vent aperture is closed by a resilient flapper valve.

11. A method of installing a mine roof support, comprising:

placing a mine roof support comprising at least two sections in an installation location on a floor within a room of an underground mine, each of the at least two sections having a frusto-conical configuration and being flared outwardly from an upper end to a lower end thereof, at least one of the at least two sections being nested within at least one other of the at least two sections and an outermost section of the at least two sections being the only section having a floor proximate a lower end thereof, each other section of the at least two sections having an open lower end;

telescopingly extending an innermost section of the at least two sections upwardly along a single longitudinal axis within a next adjacent section until an outer surface above the lower end of a section continuously circumferentially contacts and frictionally engages with an inner surface below the upper end of the next lower, adjacent section to secure the innermost section to the next adjacent section with a substantially fluid-tight seal between the at least two sections to define a continuous interior volume of the mine roof support; and filling the continuous interior volume with a flowable, hardenable aerated medium extending continuously from a lower end of the continuous interior volume to proximate an upper end of the continuous interior volume;

wherein the at least two sections each comprise metal sheathing of a wall thickness selected to fold or wrinkle on itself responsive to compression subsequent to hardening of the flowable, hardenable aerated medium located within the continuous interior volume.

12. The method of claim 11, wherein the at least two sections comprise three sections, and a section intermediate the innermost section and an outermost section is pulled upwardly by the innermost section after frictional engagement with the innermost section until an outer surface of the lower end of the intermediate section continuously contacts and frictionally engages with an inner surface of the outermost section to frictionally engage and secure the intermediate section to the outermost section.

13. The method of claim 12, further comprising extending the three sections in a telescoping manner to be mutually, frictionally engaged to a height approximating a height of a roof of the room of the underground mine above the floor of the room of the underground mine.

14. The method of claim 11, further comprising securing the innermost section to a roof of the room of the underground mine.

15. The method of claim 11, wherein filling the continuous interior volume of the mine roof support with a flowable, hardenable aerated medium comprises filling the interior volume with a slurry of aerated cementitious material.

16. A pre-installation assembly for a mine roof support, comprising:

multiple tubular, frusto-conical sections in a nested arrangement, a skirt portion of each section defining a larger diameter than a neck portion of a next outer adjacent section, wherein each section is flared outwardly from an upper end to a lower end thereof at substantially a same angle $\alpha$ of departure to a longitudinal axis of the section to enable, upon mutual telescoping extension of the multiple tubular, frusto-conical sections along a single longitudinal axis, at least one wall surface proximate an end of each section to continuously circumferentially frictionally engage a wall surface proximate an end of at least one other section, secure each section to at least one other adjacent section and form a substantially fluid-tight seal between adjacent sections when mutually telescopingly extended to define a continuous interior volume of the mine roof support;

an outermost tubular, frusto-conical section of the multiple tubular, frusto-conical sections in the nested arrangement comprising a floor proximate a lower end thereof;

each other tubular, frusto-conical section of the multiple tubular, frusto-conical sections having an opening through a lower end thereof; and the multiple, tubular, frusto-conical sections each comprising metal sheathing having a wall thickness selected to fold or wrinkle on itself responsive to compression of a hardened, aerated compressible medium within the continuous interior volume of the mine roof support.

17. The pre-installation assembly of claim 16, wherein the same angle $\alpha$ of departure is between about 0.01° and about 3°.

18. The pre-installation assembly of claim 16, wherein an innermost section further comprises structure for attachment of the mine roof support to a mine roof.

19. The pre-installation assembly of claim 16, wherein an innermost section further comprises a vent aperture adjacent an upper end thereof.

20. The pre-installation assembly of claim 16, wherein at least one of the multiple tubular, frusto-conical sections further comprises an inlet port for receiving a flowable medium into an interior volume of the mine roof support.

* * * * *